United States Patent [19]

Zhabokrug

[11] Patent Number: 4,618,918

[45] Date of Patent: Oct. 21, 1986

[54] UNIVERSAL FILTER CHANGER FOR THEATRICAL LIGHTS

[76] Inventor: Ilya Zhabokrug, 434 16th Ave., San Francisco, Calif. 94118

[21] Appl. No.: 740,528

[22] Filed: Jun. 3, 1985

[51] Int. Cl.[4] ..... F21V 9/08

[52] U.S. Cl. ..... 362/281; 362/283; 362/293

[58] Field of Search ..... 362/280, 281, 293, 283

[56] References Cited

U.S. PATENT DOCUMENTS

| | | | |
|---|---|---|---|
| 1,818,718 | 8/1931 | Kliegl | 362/283 |
| 2,129,641 | 9/1938 | Baughman et al. | 362/284 |
| 2,950,382 | 8/1960 | Hatch | 362/281 |
| 3,069,536 | 12/1962 | Dion et al. | 362/280 |
| 3,833,295 | 9/1974 | Bebb et al. | 362/281 |
| 4,298,920 | 11/1981 | Gluck et al. | 362/281 |

*Primary Examiner*—William A. Cuchlinski, Jr.
*Attorney, Agent, or Firm*—David Pressman

[57] ABSTRACT

A universal filter changer for theatrical lighting units comprises a casing, a mechanism for attachment of the filter changer to the lighting unit, a set of filter holders with lighting filters, and a unit for switching the filter holders with filters between two extreme positions. This unit of a set of identical switching mechanisms the number of which corresponds to the number of the filter holders. Each mechanism is formed by a movable part which can rotate with respect to a stationary part by means of an electromagnet which controls a mechanism which in turn prepares fixing pawls for fixing the movable part, and hence the respective filter holder, with a filter in one of extreme positions of its rotation. With the use of such mechanism, the filters can be selected in any random sequence as well as in any combination. The mechanism can be controlled manually via a remote control panel or interfaced to a microprocessor-based controller.

6 Claims, 19 Drawing Figures

UNIVERSAL FILTER CHANGER FOR THEATRICAL LIGHTS

BACKGROUND

1. Field of the Invention

The present invention relates to lighting engineering, particularly to a filter changer for theater light units.

2. Description of Prior Art

Known in the art (USSR Author's Certificate No. 735,860 to me and two others, 1980) is a universal filter changer for mounting on theater light units. This filter changer comprises a casing, means for attachment of the casing to a light unit, a set of filter frames, and a mechanism for switching the filter frames between two extreme positions. The switching mechanism consists of a stationary part, fixed to the casing, and a movable part, which can rotate with respect to the stationary part together with filter frames which carry corresponding color filters. The movable part is driven by an electromagnet.

This filter changer, however, entails a number of disadvantages; the main ones are as follows:

(a) the method of fixation of the light filters in their extreme positions is unreliable and hence may result in failure;

(b) the clamp for attachment of the filter changer to the lighting unit makes it difficult to align the center of light filters with the optical axis of the lighting unit; this offcenter alignment causes edge illumination;

(c) the light filter frames supplied with the filter changer cannot be used for mounting thin-film filters; this restricts the dimensions of the light filters used in the device, i.e., it precludes the use of large-diameter filter frames because of their heavy weight.

OBJECTS AND ADVANTAGES OF THE INVENTION

Accordingly one object of the present invention is to eliminate the disadvantages mentioned above, i.e., to provide a universal lighting filter changer with reliable fixation of the filter frames in extreme positions, accurate alignment of light filter centers with the optical axis of a lighting unit of any existing type or dimensions, the ability to use light filters made of incombustible films of any desired thickness, and improved reliability of operation. Another object of the invention is to provide a light filter changer which is simple to manufacture and to use and which can be attached to a lighting unit housing in different positions in order to adjust to various specific conditions. Still further objects and advantages will become apparent from a consideration of the ensuing description and drawings.

REFERENCE NUMERALS USED IN SPECIFICATION AND DRAWINGS

20—casing; 22—filter switching mechanism; 24—protective cover; 26—base; 27, 29—screws; 28—cylindrical columns; 32—plate; 34—crosspiece; 36—collecting bus; 38—plug-and-socket assemby; 40—transverse slots; 42—screws; 44—pin; 46—nut; 48—plate; 50—sockets; 52—cover; 53—longitudinal slot; 54—front stopper; 56—screws; 58—stator; 60—sleeve; 62—rotor; 64—axle; 66, 68—column; 70—electromagnet cores; *72a, 72b*—pins; 74—coil; *76a, 76b*—helical springs; 78—limit switch; 80—control arm; 82—plug; 84—terminal plate; 86—counterbalance plates; 88—screw; 90—bracket; 92, 94—pins; *96a*—camming surface; *96b, 98b*—semicircular recesses; 96, 98—pawls; 100—column; 102—slider; 104—pusher; 108—link; 109—opening; 110, 112—springs; 114—shoulder; 116 A,B,C ; 117 A,B,C—semicurcular elements; 118, 120—arch straps; 122—filter holders; 124—clamp; 125—attachment means; 127—first attachment mechanism; 126—catcher; *127a*—wire net elements; 128—catcher; 129—beads; 130—plate; 132—screw; 134—angle piece; 136—screws; 137—second attachment; **138, 138*a*—sleeves; 140—screws; 142—prismatic elements; 141—threaded hole; 144—rod; 146—threaded hole; 147, 148—clamp; 150—dog; 151**—third attachment; Z—bracket-like hooks.

DESCRIPTION OF THE PREFERRED EMBODIMENT OF THE INVENTION

FIGS. 1 AND 2

Figure 1:
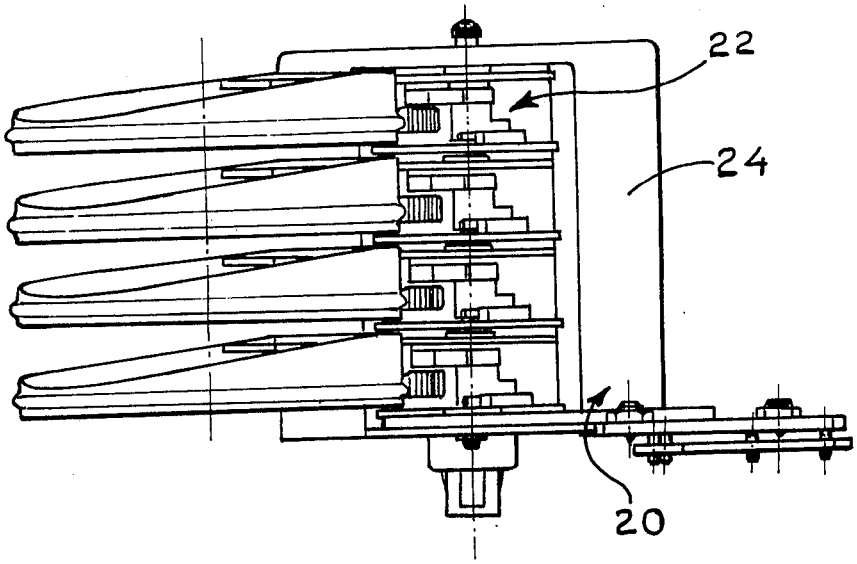
FIG. 1 is a general plan view of a light filter changer of the invention.
Figure 2:
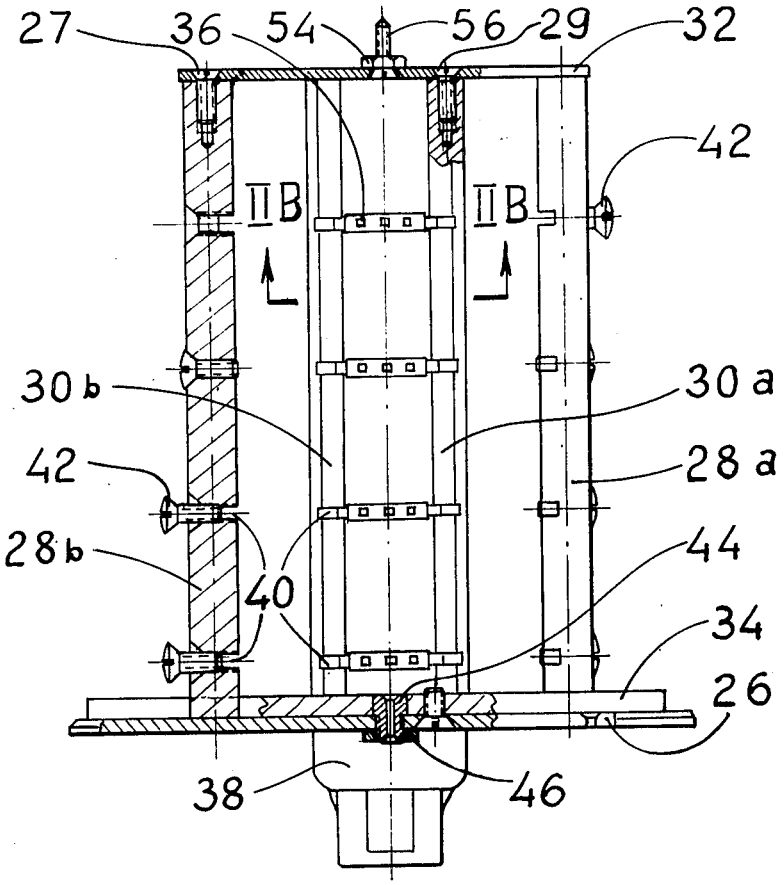
FIG. 2 is a cross-sectional view of the casing of the changer along line II—II of FIG. 2A.

A light filter changer of the invention is shown in FIGS. 1 and 2. It consists of a permanent unit or casing 20; this supports a number of filter switching mechanisms 22. Casing 20 20 has a protective cover 24 and quick-changeable units which will be described later—these are replaced depending on the parameters and design of the lighting unit on which the filter changer is to be installed.

Figure 2A:
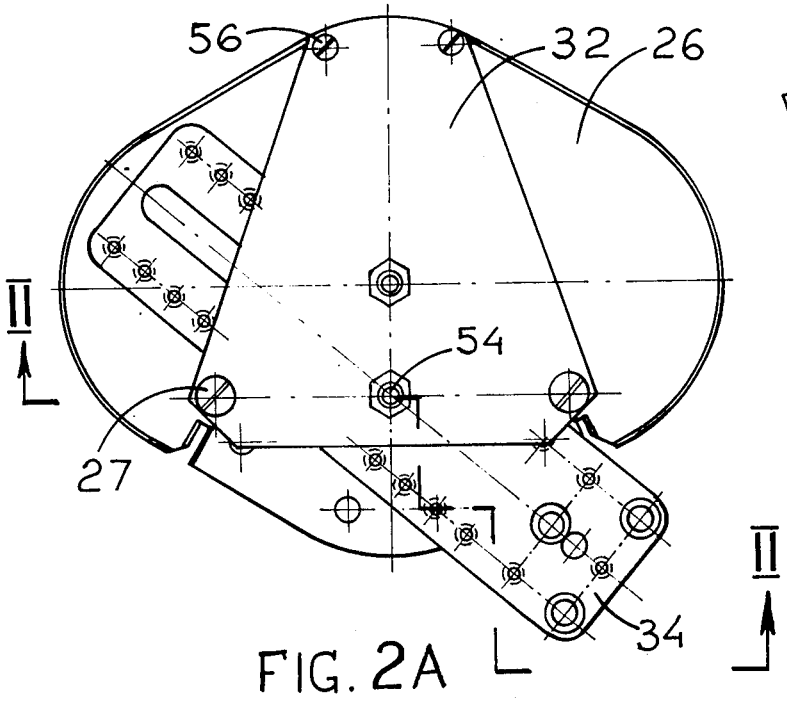
FIG. 2A is a plan view of the casing of FIG. 2.
Figure 2B:
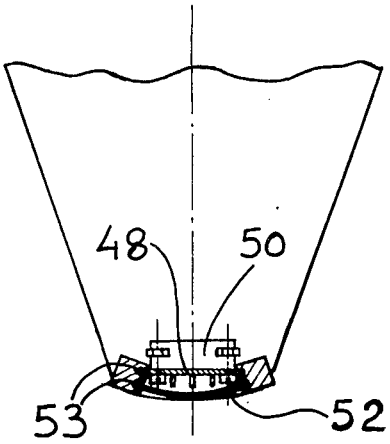
FIG. 2B is a partial cross-sectional view along lines IIB—IIB of FIG. 2.

Casing 20 is shown in more detail in FIGS. 2, 2A and 2B. It consists of a base 26, two cylindrical columns 28*a*, 28*b*, two columns 30*a* and 30*b* having a square cross section, a plate 32, a crosspiece 34, a collecting bus 36, and a plug-and-socket assembly 38. Base 26, columns 28 and 30, and plate 32 are interconnected by screws 27 and 29, thereby forming an integral carrying frame for the filter changer.

Columns 28 and 30 are provided with transverse slots 40 which serve to receive filter switching mechanisms 22. Mechanisms 22 are fixed to the columns by screws 42.

Crosspiece 34 is pivotally connected to base 26 by means of a pin 44. Pin 44 also serves as a rear stopper for switching mechanisms 22 and is fixed in its required position by nuts 46.

Collecting bus 36 consists of a plate 48 with sockets 50 and a cover 52. The collector bus is inserted into longitudinal slots 53 of columns 30 and serves for electrical interconnection between filter switching mechanisms 22 and a multicontact plug of plug-and-socket assembly 38 for connecting a power supply cable (not shown) to the filter changer.

Plate 32 is provided with a front stopper 54 for filter switching mechanisms 22 and a screw 56 for attachment of protective cover 24 to the filter changer.

The light filter changer contains a set of filters and several filter switching mechanisms 22 which are identical and the number of which in the assembly corresponds to the number of filters in the set. Therefore only one typical filter switching mechanism 22 will be now described.

FILTER SWITCHING MECHANISM

Figure 3:
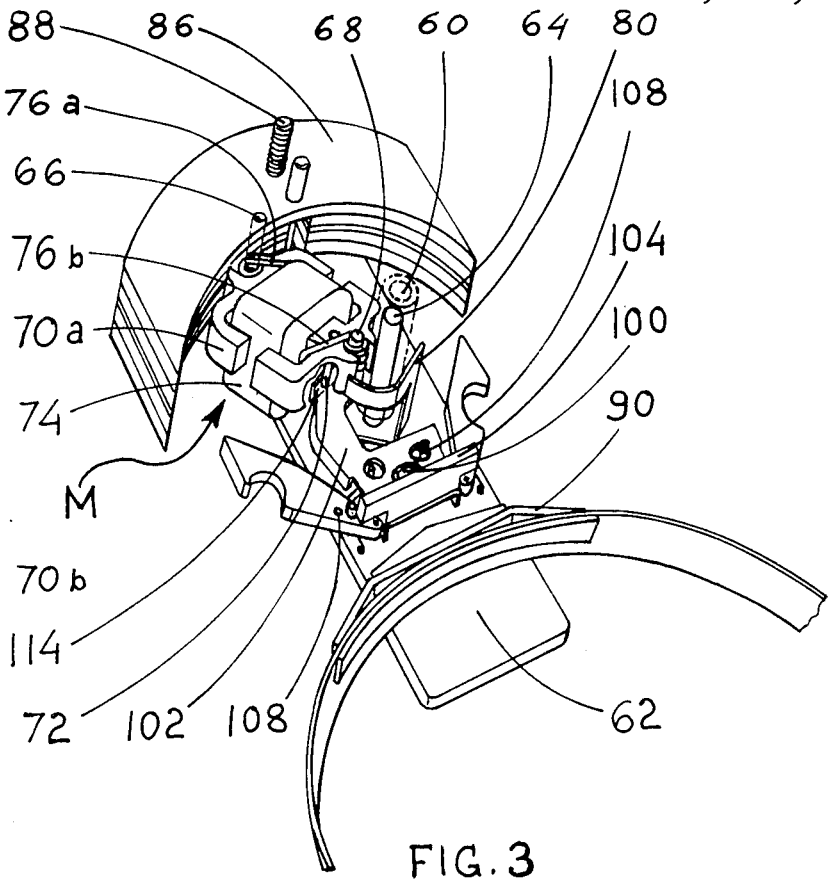
FIG. 3 is a perspective view of the switching mechanism with some parts omitted for the sake of clarity.
Figure 3A:
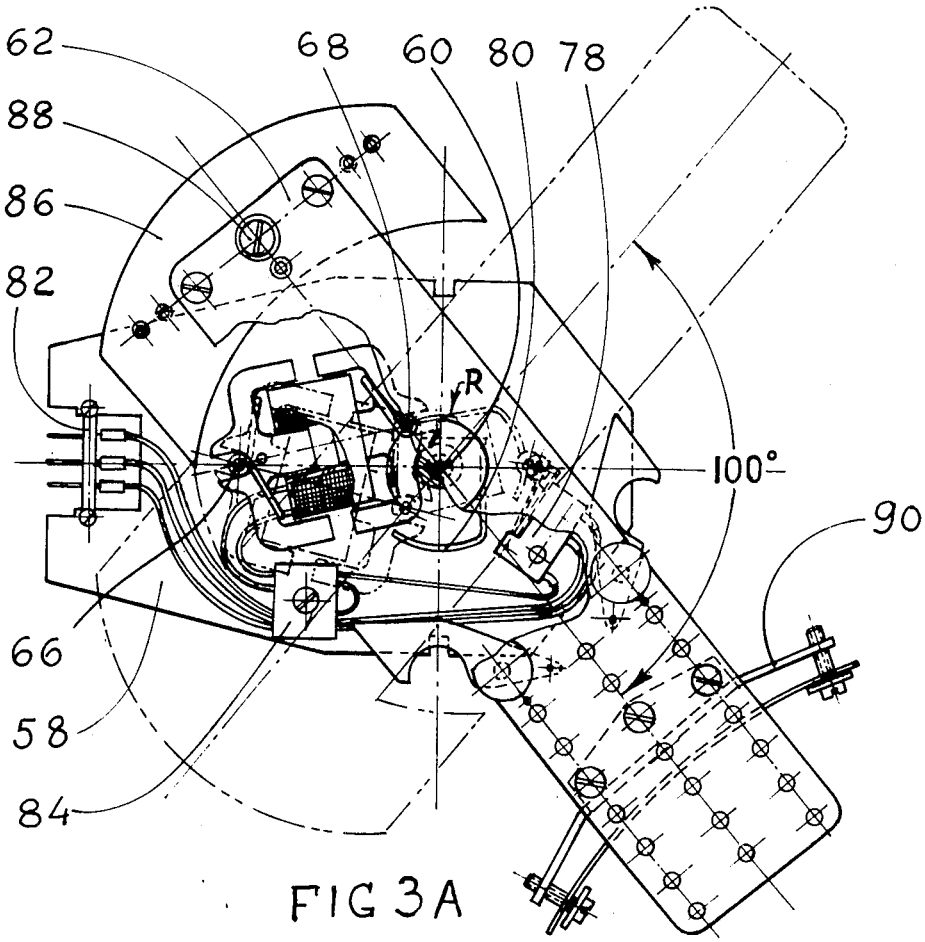
FIG. 3A is a plan view of the device shown in FIG. 3.

FIGS. 3 and 3A

Filter switching mechanism 22 (FIGS. 3 and 3A) serves for switching a required light filter from its initial or inoperative position to an operative position, i.e., in the path of the light beam radiated by the lighting unit, as well as for returning the filter into its initial or inoperative position.

The mechanism consists of a stator 58 which is rigidly connected to the casing of the filter changer and a rotor 62 which can rotate relative to the stator on an axle 64. Axle 64 is rigidly connected to the rotor and inserted into a sleeve 60 of the stator.

Pins 66 and 68 are mounted on the stator and rotor, respectively. An electromagnet designated generally by letter M (FIG. 3) is arranged between pins 66 and 68. Magnet M is formed of two identical cores 70*a* and 70*b*, pin 72, and a coil 74. Cores 70*a* and 70*b* are connected to corresponding pins 66 and 68 by helical springs 76*a* and 76*b*, respectively. Springs 76*a* and 76*b* are compressed and then are inserted into slots 71*a* and 71*b* which are formed in cores 70*a* and 70*b*, respectively. The springs thus tend to urge the cores to their associated columns.

The mechanical system formed by the elements mentioned above is, in fact, a crank mechanism where axle 64 is a shaft, column 68 is a crank, and cores 70*a* and 70*b* form a connecting rod which moves when the electromagnet is energized.

A limit switch 78 is mounted on stator 58 and a control cam 80 is fixed to rotor 62. In an intermediate position of the rotation of rotor 62, cam 80 comes into contact with the actuating element of limit switch 78, opens its normally-closed contacts, and closes its normally-open contacts (not shown in the drawings). This results in actions which will be described later.

The stator also supports a plug 82 which is inserted into socket 50 of collecting bus 36. Thus plug 82 supplies voltage to electromagnet coil 74. Also the stator supports a terminal plate 84. Rotor 62 supports counterweight plates 86 fixed by a screw 88. Rotor 62 also supports a bracket 90 for attachment of frames with light filters, pins 92 and 94 on which pawls 96 and 98, respectively, are pivotally mounted, and an axle 100 which retains a slider 102 with a pusher 104. Each pawl 96 or 98 has a camming surface, 96*a* or 98*a*, respectively, which is designed for engagement with column 28*a* or 28*b*, and semicircular recess 96*b* or 98*b* for snapping onto the columns mentioned above. Such snapping action will be described later in connection with the description of operation of the switching mechanism.

FILTER CHANGING MECHANISM IN CROSS SECTION

FIG. 4

Figure 4:
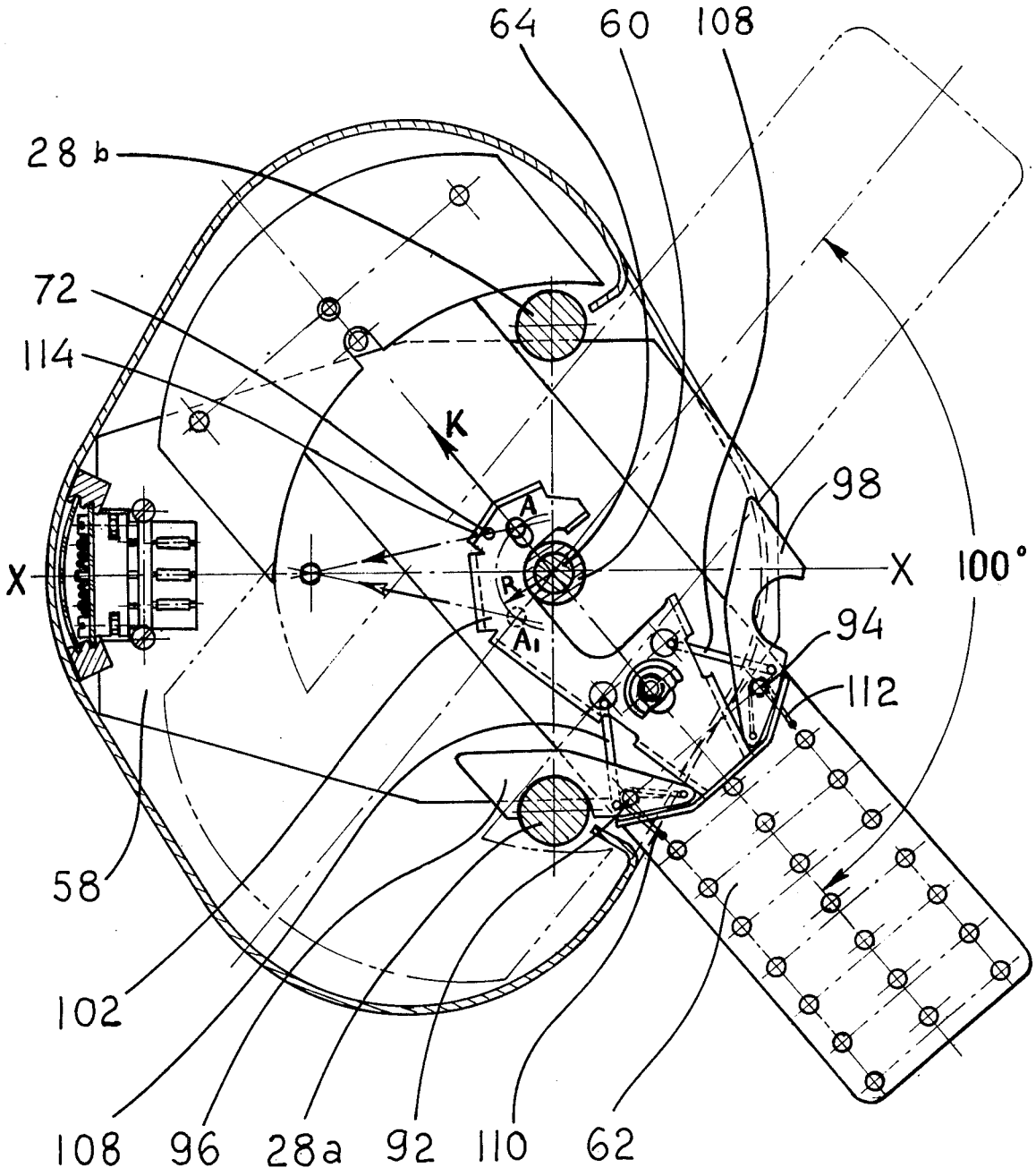
FIG. 4 is a front view illustrating means which control operation of the automatic locking mechanism of the filter changer.

FIG. 4 shows in cross section a typical filter changing mechanism of universal filter changer. This view illustrates the position of slider 102 which is mounted on rotor 62. Links 108, which are arranged between the slider and pawls 96 and 98, respectively, are used for retracting the pawls from columns 28*a* and 28*b*. The mechanism has springs 110 and 112 which lock pawls 96 and 98 on columns 28*a* and 28*b* respectively, a shoulder 114 of slider 102, and of other parts which were described earlier and work in association with pawls 96 and 98.

FILTER FRAMES

FIGS. 5, 5A, 6, 6A, 7 and 7A

FIGS. 5, 5A, 6, 6A, 7 and 7A illustrate a set of filter frames of different types and dimensions which are used in association with the filter changer of the invention. Although this set is described and shown as filter frames of three types and dimensions, it will be understood by those skilled in the art that it may consist of two different filter frames or may be divided into more than three types and dimensions. In the particular embodiment shown in the drawings, the filter frames differ by 3.8 cm (1½") in diameter; this enables attachment of the filter changer of the invention to lighting units having light aperture diameters (lenses) from 76 cm to 61 cm. The angle of light scattering from such units is 60° or more (e.g., for the filter changer equipped with four or less light filters).

Each filter frame is formed by two semicircular elements 116A and 117A, 116B and 117B, or 116C and 117C. Each pair of semicircular elements is interconnected by two arched straps 118A and 120A, 118B and 120B, and 118C and 120C. The arched straps are connected to corresponding semicircular elements by rivets (not shown in the drawings). The interconnected semicircular elements form a complete circle. All parts of the ring can be made, e.g., of a sheet aluminum alloy of a medium hardness. The attachment elements of all filter frames are of equal size and are provided with standard slots for mounting and fixing any filter frame of the set to bracket 90 of the filter switching mechanism.

All filter frames are formed with annular grooves 121A, 121B, and 121C respectively. These annular grooves improve the rigidity of the frame and retain the light filters in the plane of the central cross section of the frames.

In frames with diameters up to 28 cm (FIGS. 5 and 5A), the groove is directed radially outward and filter holders 122, which hold filter F1 in the central plane of the frame, are made in the form of two triangular elements. Frames of this type are designed for relatively thick and rigid filters F1 having a thickness of 0.25 mm to 0.50 mm. The triangular elements can be formed, e.g., of spring wire of 1 mm to 1.5 mm in diameter. The light filter is supported in a required position due to resilient deformation of wire. Each of two triangular elements (hereinafter referred to as a filter holder) 122 is locked by a clamp 124. One end (122A) of filter holder 122 is inserted in the annular groove and bent so that its retraction from the frame is prevented. The filter holders are angularly shifted by approximately 60°.

Figure 6:
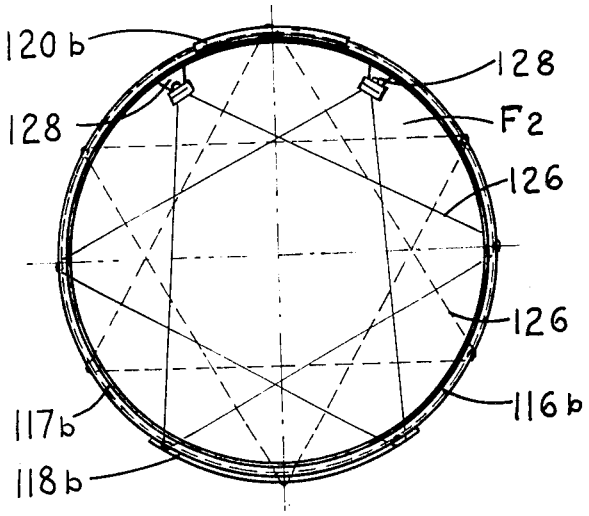
FIG. 6 is a front view of frame for filters of a medium thickness.
Figure 6A:
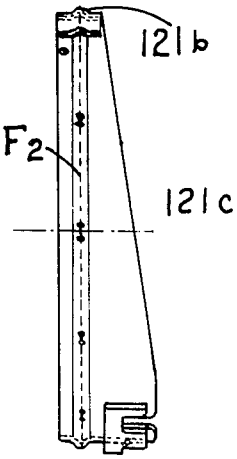
FIG. 6A is side view of the filter frame of FIG. 6.

FIGS. 6 and 6A show a filter frame for a diameter range of 30.5 cm to 51 cm. This filter frame has a holder for filter F2 which may have a thickness of 1.2 mm down to 0.25 mm. The holders retain the filters in an annular groove 121B and are made, e.g., in the form of two hexagonal net elements 126 made of a resilient stainless-steel wire with a diameter of 0.13 mm to 0.18 mm. These wire net elements are interweaved into openings 121C (FIG. 6A) of the frame which are formed in annular groove 121B. Two corners of one of net elements are connected to the frame by catchers 128 and can be disconnected and removed from the plane of the filter frame.

Figure 7:
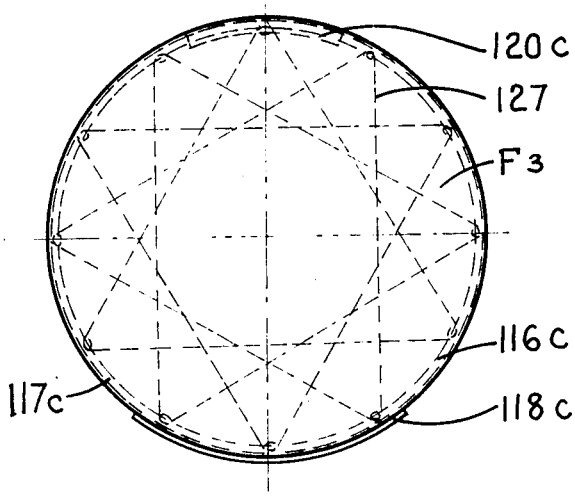
FIG. 7 is a front view of frame for a thin-film filters.
Figure 7A:
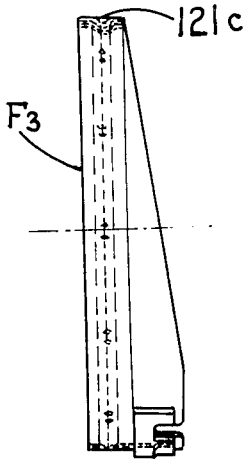
FIG. 7A is a side view of the filter frame of FIG. 7.

FIGS. 7 and 7A illustrate a design of filter frames with a diameter of 53 cm to 76 cm. They have similar wire net elements 127; the only difference is that both net elements 127 are interweaved permanently into openings of an annular groove 127A which is formed on the outer periphery of the filter frame. Elements 127 are intended for imparting rigidity to the filter frame only, and not for supporting the filter. The filter frame of this type is intended for supporting very thin filters, i.e., those made of 25.4 to 76 micron thick films.

A subdivision of filter thicknesses into different groups, depending on the diameter of the filter frames, is determined by the allowable mass (weight) of the light filters; their weight increases in proportion to the square of their diameter. The design of the filter frame is determined also by the thickness or rigidity of the filter itself. Therefore the particular embodiments described above are shown only as examples.

ATTACHMENT MECHANISM

Figure 8:
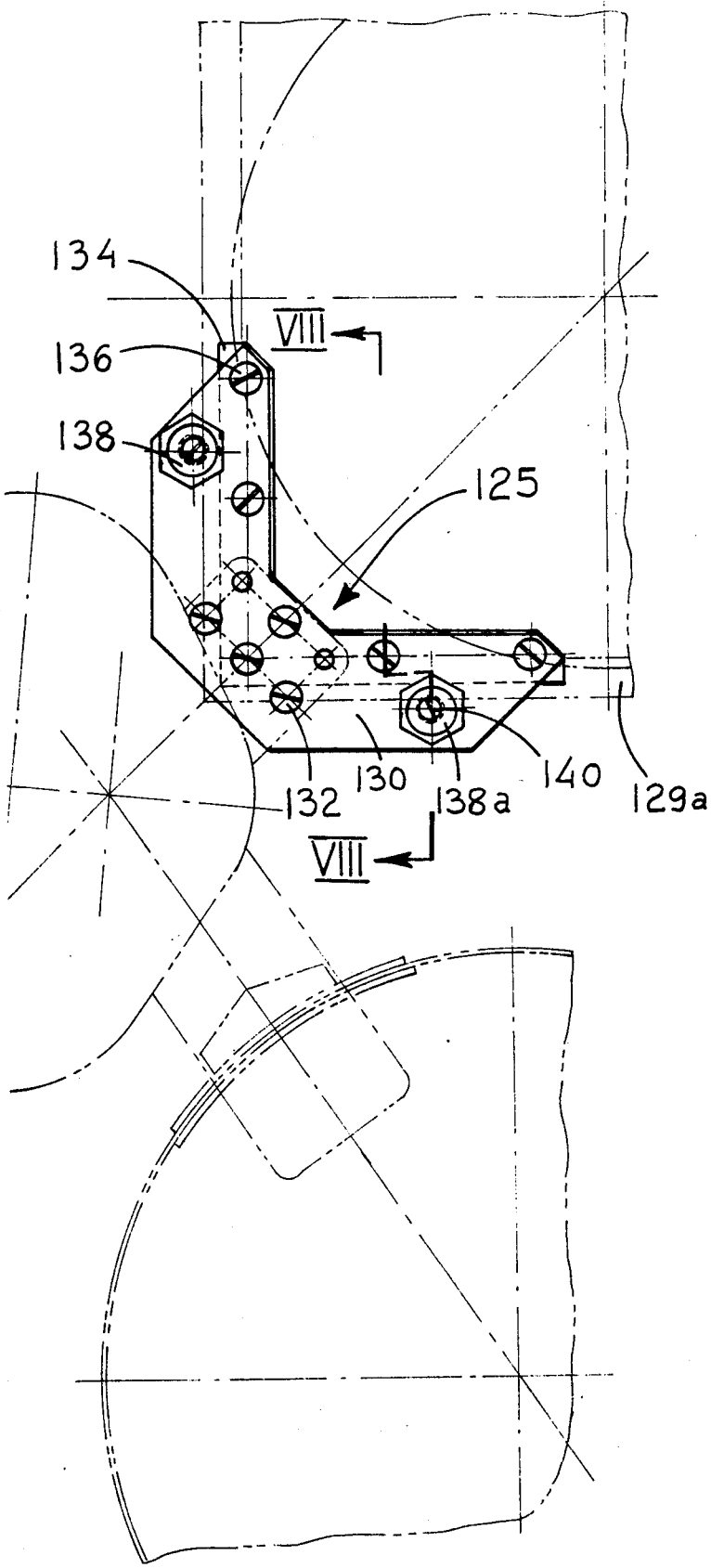
FIG. 8 illustrates an embodiment of the mechanism for attachment of the filter changer to a corner of the lighting unit housing.
Figure 8A:
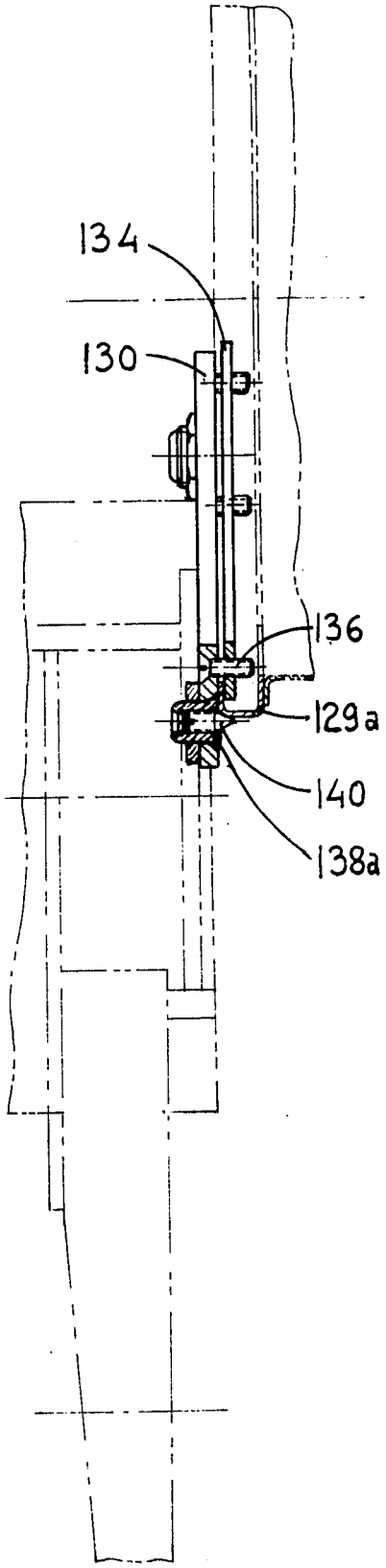
FIG. 8A is a cross-sectional view along lines XIII—XIII in FIG. 8.

FIGS. 8 and 8A

As has been mentioned above, the filter changer of the invention can be attached to a lighting unit of any standard type. This is achieved by means of a set of attachment fixtures which are indispensable parts of the filter changer of the invention. Three types of attachment fixtures will be now shown and described; they are most preferable for the purposes of the present invention since they are designed for attachment of the filter changer to any standard lighting unit in the art. It is obvious, however, that any other modifications which enable the filter to be for attached to a non-standard or any special lighting unit can be used if they do not depart from the scope of the present invention.

A first attachment mechanism 125, which is shown in FIGS. 8 and 8A, is designed for attachment of the filter changer to lighting units used mainly in theaters. Mechanism 125 has on its front surface a yoke for attachment of various devices such as light filters and masks which provide light effects. The yoke consists of three beads, two of which 129A and 129B, are shown in FIGS. 8 and 8A. These beads are formed of sheet metal bent into a required U-shaped profile (FIG. 8A). Two of these beads are parallel to one another and the third one (129A) is perpendicular to them. The beads embrace a lighting window from its three sides.

Attachment mechanism 125 consists of a plate 130; this is attached by means of screws 132 to a free end of crosspiece 34 of the filter changer. An angle piece 134 is attached to plate 130 by screws 136 and sleeves 138, **138*a* with non-slip lock screws 140**.

A second attachment mechanism 137 is designed for attachment of the filter changer to lighting units of the type used mainly in the television and moving picture industries. Such units are usually provided either with three bracket-like hooks Z (FIG. 9) arranged on the front surface on three mutually perpendicular sides around a lighting window (lens) of the unit, or with two mutually parallel slots on two opposite sides around the light window (lens) of the lighting unit.

Figure 9:
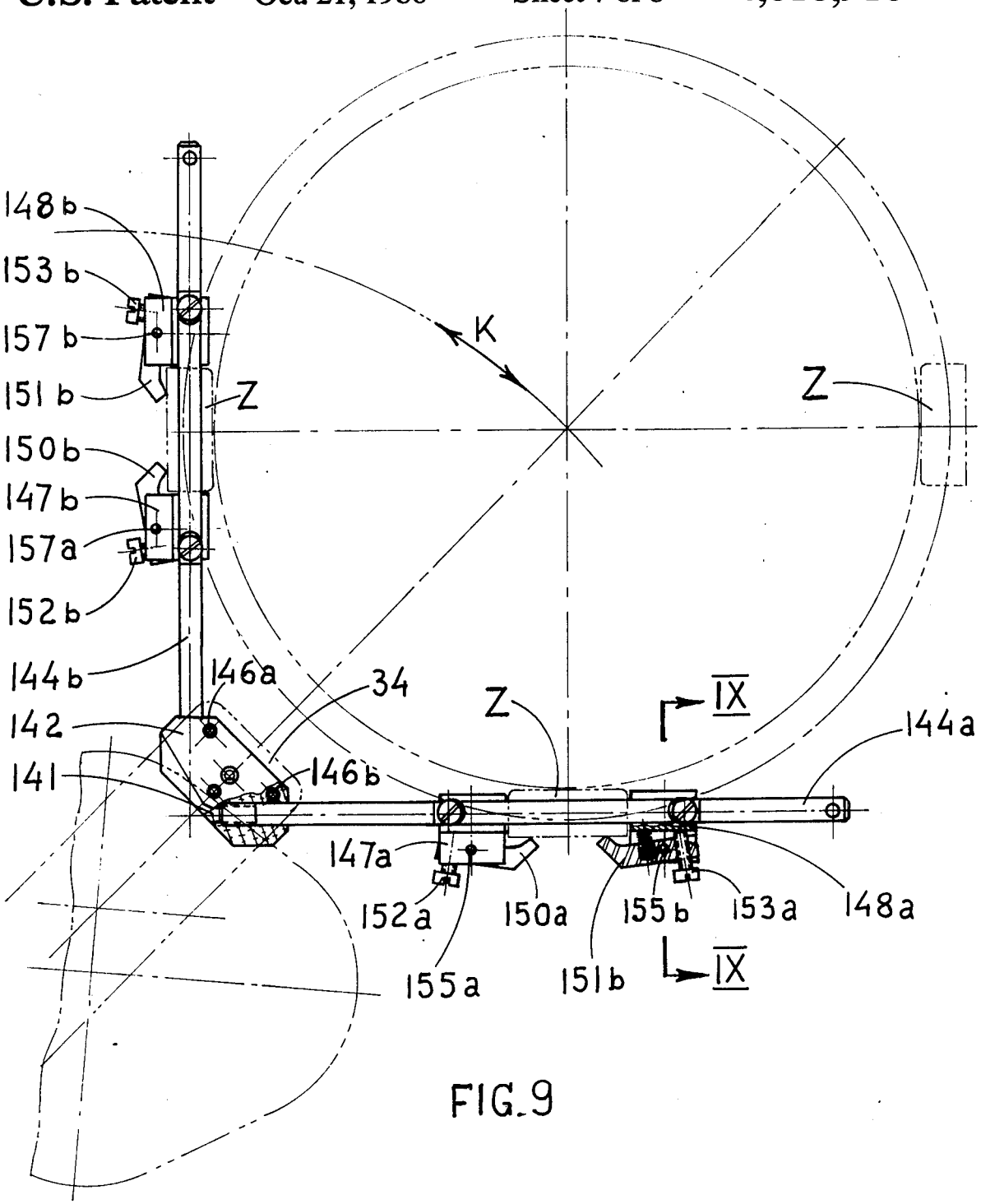
FIG. 9 is an embodiment of a mechanism for attachment of the filter changer to hooks on the side of the lighting unit housing.
Figure 9A:
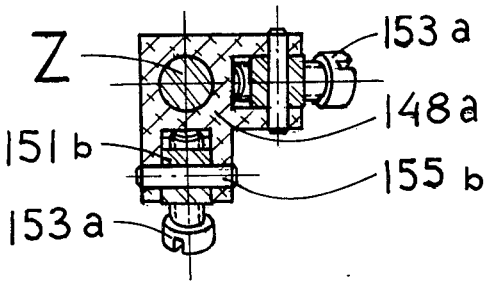
FIG. 9A is a cross-sectional view along IX—IX in FIG. 9.

A second attachment mechanism 137 consists of a prismatic element 142 having two mutually perpendicular threaded holes (one of which is shown in FIG. 9 at 141). Two rods 144A and 144B of the set are screwed into these holes. The length of these is selected from the set, depending on the dimensions of the lighting unit on which the filter changer is mounted. Threaded holes 146A and 146B of the prismatic element serve for attachment of crosspiece 34. Each of rods 144A and 144B has a pair of identical clamps 147A, 148A, and 147B, 148B respectively. Each pair of clamps has facing dogs 150A—151A and 150B—151B, respectively. Each dog is provided with a screw (152A, 153A, 152B, 153B) which can turn the respective dog about its pivot 155A, 155B, 157A, or 157B, respectively.

Figure 10:
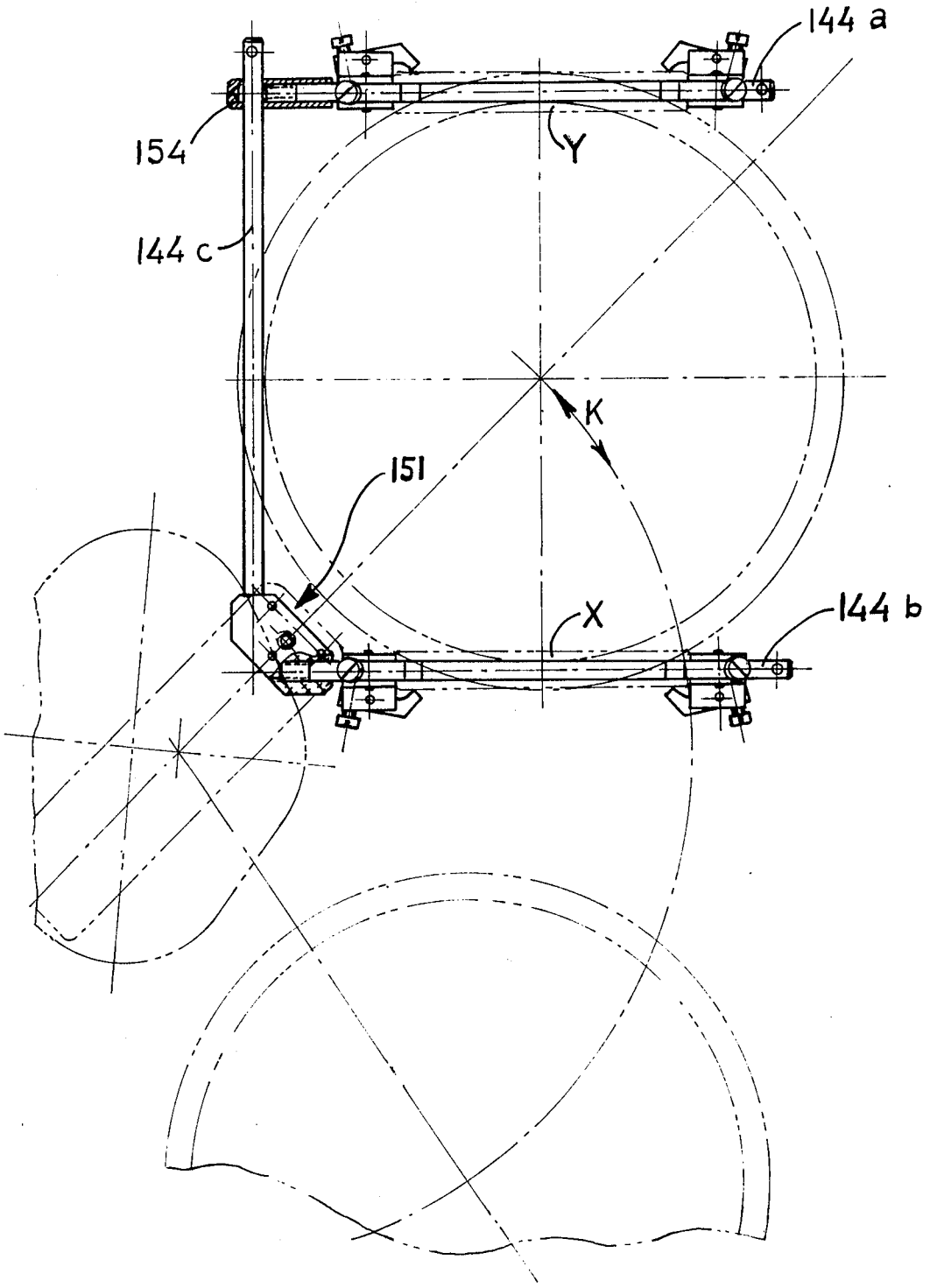
FIG. 10 illustrates still another modification of attachment of the filter changer to a lighting unit provided with two mounting slots on opposite side walls of the housing.

A third attachment mechanism 151 is shown in FIG. 10. The mechanism of this type is designed for attachment of the filter changer to lighting unit having two slots X and Y arranged on a front surface on opposite sides of the lighting window (lens) of the unit. The attachment mechanism includes three rods 144A, 144B, and 144C from the set supplied with the attachment mechanism. The length of the rods is chosen according to the dimensions of the particular lighting unit to which the filter changer is to be attached. This third attachment mechanism has also a sleeve 154 which is used for interconnection between rods 144C and 144A.

OPERATION OF THE FILTER CHANGER OF THE INVENTION

The design of the filter changer of the invention allows its attachment and subsequent operation with lighting units of any type.

ATTACHMENT OF THE FILTER EXCHANGER TO A LIGHTING UNIT

FIGS. 8, 8A, 9 and 10

Figure 1A:
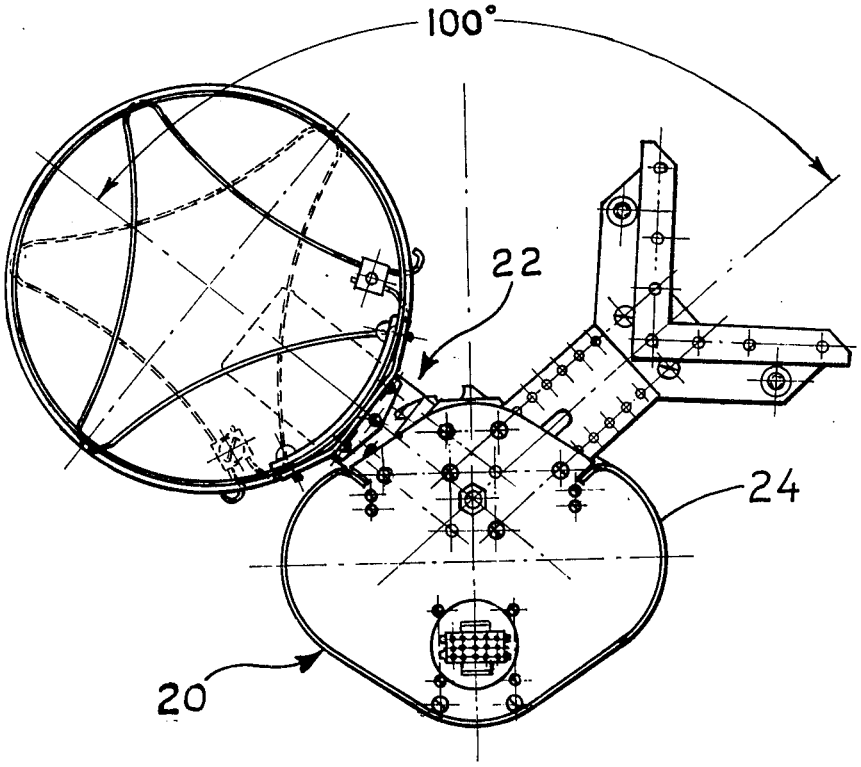
FIG. 1A is a rear view (i.e. from the side of the lighting unit) of the filter changer of FIG. 1.

First, attachment mechanism 127 (FIG. 8) is used when the filter changer is to be mounted on a theater-type lighting unit having a yoke on its front surface. As shown in FIGS. 1 and 1A, in this case the filter changer is fixed to crosspiece 34 by screws 132 and then, as shown in FIGS. 8 and 8A, a gap of about 3 mm is created between plate 130 and angle piece 134 by loosening screws 136. The outer edges of angle piece 134 are inserted into U-shaped slots of two mutually perpendicular yoke elements of the lighting unit until screws 136 contact the edges of the slots. Screws 136 are then tightened until plate 130, and simultaneously angle piece 134, comes into tight contact with opposite surfaces of the edges of the yokes. Screws 140 are screwed with a light force through sleeves 138 and 138*a* so that the filter changer is self-aligned on the corners of the lighting unit. Screws 136 are finally tightened and, if necessary, locked. Disconnection of the filter changer is carried out in reverse order.

In case of mounting the filter changer by means of the second attachment mechanism 137 (FIG. 9), it is advantageous first to fix the parts of the attachment mechanism to the lighting unit as shown in FIG. 9. For this purpose, two rods of the attachment mechanism are inserted into slots of two of the three mutually perpendicular bracket-like hooks Z1 and Z2. Clamps 147, 148 are arranged on opposite sides of the bracket and are moved along rods 144A and 144B until they contact the brackets. Thereupon dogs 150A—151A and 150B—151B will embrace bracket-like hooks Z1 and Z2 from both side and in two mutually perpendicular directions. Screws 152 are then tightened to fix attachment mechanism 151 to the lighting unit. Arrow K in FIG. 9 indicates the direction of rotation of the filters during their switching from one position to another.

If, as shown in FIG. 10, the lighting unit has only two slots , two rods 144B and 144C are screwed into prismatic element 142. The third rod 144A is, by means of sleeve 154 (chosen from the set), attached to rod 144C so that the distance between rods 144B and 144A is the same as the distance between slots X and Y.

Clamps 147 and 148 are fit onto rods 144A and 144B so that the clamps face each other, along with clamping dogs 149 and 151. Clamps 147 and 148 are shifted along the respective rods, whereas the rods themselves are inserted into slots X and Y until the generatrix of the rod rests onto the bottom of the slot. Rod 144A is tightly screwed into sleeve 154 so that the latter is fixed to rod 144C.

The position of the system formed by the three rods are adjusted so that rod 144C is located relative to the center of the lighting window (lens) of the lighting unit at a distance equal to the half of the distance between rods 144A and 144B.

With such an arrangement of rods 144A, 144B and 144C, clamps 147 and 148 are shifted until they contact opposite sides of slots X and Y so that dogs 151 and 149 embrace slots X and Y from both sides and in opposite directions. Then the attachment mechanism is fixed to the lighting unit by tightening the screws on the dogs.

The disconnection of the attachment mechanism is carried out in reverse order. The direction of rotation of filters during their switching from one position to another is indicated by arrow L in FIG. 10.

After mounting the attachment mechanism on the lighting unit, the free end of crosspiece 34 of the filter changer is attached to the front surface of prismatic element 142 and then the crosspiece is fixed by screws inserted into threaded holes 146 of prismatic element 142.

SELECTION AND INSTALLATION OF FILTERS

The next step is the selection of size and type of required filter frames from the set so that the desired scattering angle of the light beam radiated from the lighting unit will be obtained without edge illumination. The selected frames are then equipped with filters.

Figure 5:
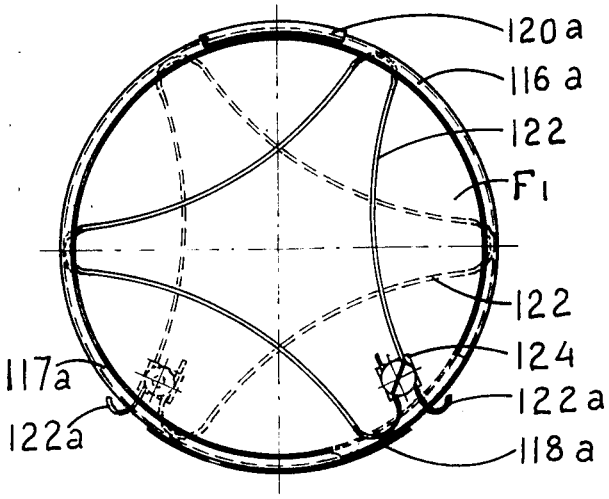
FIG. 5 is a front view of a filter frame for thick-film filters.
Figure 5A:
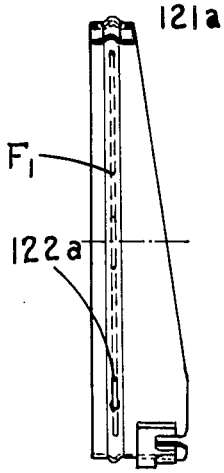
FIG. 5A is a side view of the filter frame of FIG. 5.

The frames shown in FIG. 5 are equipped with light filters cut from incombustible film material having a thickness of 1.3 mm to 0.5 mm. The frames shown in FIG. 6 are supplied with filters having a thickness between 0.13 mm to 0.25 mm. The outer dimensions of the light filter must correspond to the inner dimensions of its frame along the bottom of the corresponding annular groove.

In the filter frames of FIG. 5, prior to installation of the light filter, the corner of one of filter holders 122 is deformed and displaced from the plane of the frame. The filter is then inserted and located in the plane of the frame between two filter holders 122, arranging the edge of the filter along the bottom of annular groove 121A. The corner of the deformed holder is returned into its initial position and the filter is released from wrinkles.

Installation of filters into frames of FIG. 6 differs in that several catchers 128 connecting wire net elements 127 with the frame are released simultaneously, the filter is inserted into the plane between the wire net elements, and then catchers 128 are returned into their initial positions.

In both cases, the replacement of light filters takes no more than 10 seconds and the filters are replaced without disconnecting the frame from the filter changer, i.e., while the lighting unit is in working position. The filters can be replaced without the use of any tools.

The procedure of application of thin-film filters (with thicknesses from 25.4 micron to 76 microns) is as follows: (A) filters are prepared and cut according to the dimension (diameter) of the frame with an excess of 13 mm per side. If necessary, radial cuts are made in the peripheral portion of the film. (B) The external surface of the frame (which in this case is separated from the filter changer) is wrapped with a double-coated adhesive tape, e.g., of 13 mm width. (C) The filter is placed on a flat surface (e.g., a table), the filter frame is placed onto the filter, and then the filter is accurately attached to the frame by bending the excess over and attaching it to the adhesive tape uniformly over the whole periphery of the frame. (D) The excess attached to the frame by the double-coated tape is covered with a single-coated adhesive tape with the adhesive surface facing inward. The frame with the filter is then installed onto the filter changer.

BALANCING OF THE DEVICE

After installation on the filter changer the frame with filters must be accurately balanced. For this purpose, the optical axis of the lighting unit with the filter changer is arranged horizontally, protective cover 24 is removed from the filter changer, and then each filter switching mechanism 22 is preliminarily balanced. To this end, screw 88 is rotated in a counterclockwise direction, counterbalance plates 86 are moved apart, extra plates are removed or added from the set until approximate balance is achieved, and then the selected counterbalance plates are fixed in place by turning screw 88 in a clockwise direction. After preliminary balancing is performed, the mechanism is periodically turned on in order to check the balance and to correct it, if necessary.

OPERATION OF THE SWITCHING MECHANISM

FIGS. 1A, 3, 3A, 4

When a command is given to switch a light filter from one extreme position to another, i.e., from an inoperative position to an operative position in front of the light, the electromagnet is energized through the normally-closed contacts of limit switch 78. Electromagnet cores 70, which are spread apart under the action of springs 76*a* and 76*b* when the filter frame is in its extreme (inactive) position, move toward one another under magnetic attraction. Since rotor 62, which carries a bracket 90 with the frame, filter and counterbalance formed by a set of plates 86, has a relatively large mass, the movement of cores 70 first deforms (loads) springs 76*a* and 76*b*, and then the energy accumulated in the springs is transferred through column 68 to rotor 62, overcoming its inertia at rest, thereby causing it to turn with respect to stator 58.

In the structure of the present invention, reliable fixation of rotor 62 (i.e., the light filters) is achieved through the intermediary of automatic pawls 96 and 98 which are released through the motion of electromagnet cores prior to the movement of rotor 62. The force of the electromagnet is transmitted through pin 72, slider 102 (whose longitudinal slots are guided by columns 68 and 100), and two links 108.

Pusher 104 is designed for manually releasing pawls 96 and 98, when such operation is necessary.

When rotor 62 has passed approximately halfway (about 50°), through its cam 80, it opens the normally-closed contacts (not shown) and closes the normally-open contacts (not shown) of limit switch 78, thereby preparing the electric circuits of the filter changer for reception of a reverse stroke signal.

The second half of its movement rotor 62 acts through inertia, moving cores 70 apart by means of columns 66 and 68 and springs 76*a* and 76*b*.

When voltage is supplied from the control board (not shown) to the normally-open contacts of limit switch 78, the mechanism will be reversed. The voltage is supplied through plug 82 inserted into socket 50 (FIG. 2).

OPERATION OF PAWLS

FIGS. 3 and 4

Operation of the pawls will be described now in more detail with reference to FIG. 4.

As has been described above, pawls 96 and 98 are fit onto pins 92 and 94 which are in turn fixed to rotor 62. The electromagnet (not shown in FIG. 4 for the sake of clarity) is arranged between stationary column of stator 58 and movable column 68 of rotor 62.

When a filter is switched from one position to another, rotor 62 is turned about its axle 64 in sleeve 60 relative to stator 58, e.g., by 100° in a forward or reverse direction. The electromagnet force acts in the direction of arrows from column 68 to column 66, moving column along a sector of radius R from extreme position A to extreme position A1 (or back). Approximately in the middle of its stroke, when the path of column 68 intersects axis X—X, limit switch 78 turns off the supply voltage of the electromagnet, releasing column 68 from its force. Rotor 62 then moves through the second half of its movement by inertia.

After receiving a filter-switching command, the electromagnet is actuated, abuts with its pin 72 against shoulder 114 of slider 102, moves the latter with respect to rotor 62 in the direction of arrow K, and through links 108 turns pawls 96 and 98 on their respective pins 92 and 94, thereby loading springs 110 and 112. In this case, pawl 96 releases column 28*a* of casing 20, thereby releasing rotor 62, resulting in transmission of the force from the electromagnet to column 68 of rotor 62, whereby rotor 62 starts its rotation with respect to stator 58.

In the intermediate position of the stroke the electromagnet is deenergized, whereupon mutual attraction of its cores is discontinued. Pin 72 of the core exerts no pressure onto shoulder 114 of slide 102, releasing the latter. Preliminarily loaded springs 110 and 112 turn pawls 96 and 98 on their respective pins 92 and 94 through links 108 and return slider 102 in its initial position until the slider rests against short arms of pawls 96 and 98.

Continuing its rotation by inertia, rotor 62 approaches pawl 98 to column 28*a*. While sliding with its camming surface 96*a* over the column, pawl 98 is deflected and turned about pin 94, loading its spring 112 (but without action) onto slider 102 (via link 108). This occurs because the diameter of the neck of link 108 is several times smaller than the diameter of openings 109*a* and 109*b* of slider 102 into which the necks of links 108 are inserted. This provides a certain play or free movement of pawls in one direction with respect to slider 102. When the crest of the camming surface 96*a* passes over column 28*a*, pawl 96 snaps onto column 28*a* with its semicircular recess 96*b* under the effect of preliminarily loaded spring 112.

On this step the process of switching of the light filter from one extreme position to another as well as its fixation in such position is over.

REVERSING AND MANUAL OPERATIONS

When a command is sent for switching the light filter into its opposite extreme position, the operation described above is repeated, starting by a supply of voltage through preliminarily closed but normally open contacts of the limit switch to the electromagnet which is then energized for releasing column 28*b* by pawl 98 until pawl 96 snaps onto column 28*a*.

For manually switching the filters, pusher 104 is used. When the pusher is pressed, it releases a corresponding pawl through link 108. Manual switching of filters must always be started by pressing pusher 104.

CONCLUSION

Breadth of Invention

Thus it has been shown above that the filter changer of the invention provides an efficient and reliable mechanism for switching light filters as well as reliably fixing them in the switched position. The device of this type is well adaptable for semiautomatic or automatic operation under control of associated electric circuits or programmable units. It can be mounted on lighting fixture of any type and can switch filter frames of various types and dimensions with filters of various thicknesses.

Although the invention has been described and illustrated by way of its preferred embodiment, it is obvious that many other modifications of the filter changer are possible. Although four filters with four switching mechanisms are shown in the drawings, their number can be less or more than four. Filter frames are subdivided into three groups according to their weight, dimensions, or thickness of filter films. However, they can be divided into two or more than three groups with corresponding changes in their structure but without departing from the scope of the invention as defined in the attached claims. Therefore the scope of the invention should be determined, not by the examples given, but by the appended claims and their legal equivalents.

I claim:

1. A filter changer for lighting units, comprising:

a casing, a lighting unit, means for attaching said casing to said lighting unit, a set of filter holders, at least one of said filter holders containing a filter, means in said casing for switching any of said filter holders between two extreme positions, said switching means comprising a set of identical switching mechanisms, the number of said switching mechanisms corresponding to the number of said filter holders, each switching mechanism consisting of a stationary part which is rigidly connected to said casing, a moveable part which can rotate with respect to said stationary part, and means for rotating said moveable part with respect to said stationary part, said means for rotating said moveable part with respect to said stationary part comprising an electromagnet, said electromagnet consisting of a first core and a second core, each core having a tail portion, each tail portion having a U-shaped slot therein, means for fixing said moveable part with respect to said stationary part in either of said extreme positions, said means for fixing being operably controlled by said electromagnet, a first column being rigidly connected to said stationary part, a second column being rigidly connected to said moveable part, said first column being fit into said U-shaped slot of said tail portion of said first core and said second column being fit into said U-shaped slot of said second core, and resilient means positioned between each of said columns and its respective core.

2. A filter changer according to claim 1 wherein said resilient means comprises preliminarily-compressed helical springs between each of said columns and its respective core, said springs being inserted into said slots and fit onto said columns so that the ends of each of said springs constantly urge its corresponding core onto its corresponding column.

3. A filter changer according to claim 1 wherein said means for fixing comprises a pair of columns attached to said casing; a pair of pins attached to said movable part; a pair of pawls with recesses which are pivoted on said pins, respectively, each pawl being spring-loaded by means of a return spring, one end of which is fixed to said movable part and another end of which is attached to said pawl so that said pawls can be fixed onto said columns of said casing by means of said recesses.

4. A filter changer according to claim 3 further comprising a limit switch for controlling operation of said electromagnet, said limit switch being attached to said stationary part, and a cam attached to said movable part so that said cam engages said limit switch in an intermediate position of said movable part between said extreme positions, said engagement deenergizing said electromagnet and releasing said pawls from said kinematic connection, whereby under the effect of said return springs, said pawls are transferred into positions ready for fixing said movable part.

5. A filter changer according to claim 4 wherein said kinematic connection between said pawls and said electromagnet comprises a slider which is guided by said first column along the longitudinal axis of said movable part, and links which connect said slider with said pawls, said slider having a stopper, one of said cores of said electromagnet having a pin engaging with said stopper so that when said electromagnet is deenergized, said return springs of said pawls return said slider in a position in which said pawls are ready for fixation on said columns of said casing.

6. A filter changer according to claim 1 wherein said filter holder comprises a pair of semicircular elements formed by bending metal strips, said filter holder being provided with a rigid circular and wire net elements interweaved into holes formed in the body of said filter holder, said wire net elements serving to retain a lighting filter in said filter holder and for reinforcing said filter holder.

* * * * *